US011131965B2

(12) United States Patent
Charbon et al.

(10) Patent No.: US 11,131,965 B2
(45) Date of Patent: Sep. 28, 2021

(54) COMPONENT FOR A TIMEPIECE MOVEMENT

(71) Applicant: Nivarox-FAR S.A., Le Locle (CH)

(72) Inventors: Christian Charbon, Chezard-St-Martin (CH); Alexandre Fussinger, Wavre (CH); Marco Verardo, Les Bois (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 15/651,295

(22) Filed: Jul. 17, 2017

(65) Prior Publication Data

US 2018/0024499 A1 Jan. 25, 2018

(30) Foreign Application Priority Data

Jul. 19, 2016 (EP) ..... 16180228

(51) Int. Cl.

| | |
|---|---|
| ***G04B 1/16*** | (2006.01) |
| ***G04B 43/00*** | (2006.01) |
| ***G04B 13/02*** | (2006.01) |
| ***G04B 17/32*** | (2006.01) |
| ***G04B 15/14*** | (2006.01) |
| ***G04D 3/00*** | (2006.01) |

(52) U.S. Cl.

CPC ..... *G04B 1/16* (2013.01); *G04B 13/02* (2013.01); *G04B 13/026* (2013.01); *G04B 15/14* (2013.01); *G04B 17/32* (2013.01); *G04B 43/007* (2013.01); *G04D 3/0069* (2013.01)

(58) Field of Classification Search

CPC ..... G04B 1/16; G04B 43/007; G04B 13/026; G04B 13/02; G04B 17/32; G04B 15/14; G04D 3/0069

See application file for complete search history.

(56) References Cited

U.S. PATENT DOCUMENTS 2,369,338 A * 2/1945 Carlson ..... G04B 31/012 29/898.12
7,017,645 B2 * 3/2006 Johnson et al.
8,050,149 B2 * 11/2011 Karapatis et al.
8,348,496 B2 * 1/2013 Gritti et al.

(Continued)

FOREIGN PATENT DOCUMENTS

CH 240 641 1/1946
CH 338767 5/1959

(Continued)

OTHER PUBLICATIONS

European Search Report dated Mar. 1, 2017 in European Application 16180228, filed on Jul. 19, 2016 ( with English Translation of Categories of Cited Documents).

(Continued)

*Primary Examiner* — Sean Kayes

(74) *Attorney, Agent, or Firm* — Oblon, McClelland, Maier & Neustadt, L.L.P.

(57) ABSTRACT

The invention relates to a pivot arbor comprising a metal pivot (3) at each of its ends. The metal is a non-magnetic aluminium alloy in order to limit its sensitivity to magnetic fields, and at least the outer surface (5) of one of the two pivots (3) is deep-hardened to a predetermined depth with respect to the rest of the arbor to harden the pivot or pivots (3).

The invention concerns the field of timepiece movements.

14 Claims, 1 Drawing Sheet

(56) References Cited

U.S. PATENT DOCUMENTS

| | | | | |
|---|---|---|---|---|
| 9,182,742 | B2 * | 11/2015 | Von Gruenigen | G04B 1/16 |
| 9,377,760 | B2 * | 6/2016 | Von Gruenigen | G04B 1/16 |
| 9,389,587 | B2 * | 7/2016 | Von Gruenigen | G04B 1/16 |
| 2004/0231159 | A1 | 11/2004 | Shibuya et al. | |
| 2010/0254227 | A1 * | 10/2010 | Kamiya | G04B 31/004 368/101 |
| 2011/0035888 | A1 * | 2/2011 | Patel | A46B 15/0002 15/22.1 |
| 2014/0003203 | A1 | 1/2014 | Charbon et al. | |
| 2014/0198624 | A1 * | 7/2014 | Von Gruenigen | G04B 1/16 368/124 |
| 2014/0198625 | A1 | 7/2014 | Von Gruenigen et al. | |
| 2015/0378309 | A1 | 12/2015 | Von Gruenigen et al. | |
| 2016/0108544 | A1 * | 4/2016 | Dubois | C22C 19/03 148/403 |
| 2017/0020277 | A1 * | 1/2017 | Barnes | A61C 17/3436 |

FOREIGN PATENT DOCUMENTS

| | | | |
|---|---|---|---|
| CH | 707 504 | A2 | 7/2014 |
| EP | 2 680 090 | A1 | 1/2014 |
| EP | 2 757 423 | A1 | 7/2014 |

OTHER PUBLICATIONS

Office Action in corresponding Russian Application No. 2017125568. dated Nov. 24, 2020. (w/English Translation).

Office Action in corresponding Chinese Patent Application No. 201710584232 dated Dec. 2, 2020. (w/English Translation).

* cited by examiner

COMPONENT FOR A TIMEPIECE MOVEMENT

This application claims priority from European patent application No. 16180228.5 filed Jul. 19, 2016, the entire disclosure of which is hereby incorporated herein by reference.

FIELD OF THE INVENTION

The invention relates to a component for a timepiece movement and particularly to a non-magnetic pivot arbor for a mechanical timepiece movement and more particularly to a non-magnetic balance staff, pallet staff and escape pinion.

BACKGROUND OF THE INVENTION

The manufacture of a pivot arbor for a timepiece consists in performing bar turning operations on a hardenable steel bar to define various active surfaces (bearing surface, shoulder, pivots, etc.) and then in subjecting the bar-turned arbor to heat treatments comprising at least one hardening operation to improve the hardness of the arbor and one or more tempering operations to improve its tenacity. The heat treatment operations are followed by an operation of rolling the pivots of the arbors, which consists in polishing the pivots to the required dimensions. The hardness and roughness of the pivots are further improved during the rolling operation. It will be noted that this rolling operation is very difficult or even impossible to achieve with most materials of low hardness, i.e. less than 600 HV.

The pivot arbors, for example the balance staffs, conventionally used in mechanical timepiece movements are made of steel grades for bar turning which are generally martensitic carbon steels comprising lead and manganese sulphides to improve their machinability. A known steel of this type, named 20AP, is typically used for these applications.

This type of material has the advantage of being easy to machine, in particular of being suitable for bar turning and, after hardening and tempering, has superior mechanical properties which are very advantageous for making timepiece pivot arbors. These steels have, in particular, superior wear resistance and hardness after heat treatment. Typically, the hardness of arbor pivots made of 20AP steel can exceed 700 HV after heat treatment and rolling.

Although this type of material provides satisfactory mechanical properties for the horological applications described above, it has the drawback of being magnetic and capable of interfering with the working of a watch after being subjected to a magnetic field, particularly when the material is used to make a balance staff cooperating with a balance spring made of ferromagnetic material. This phenomenon is well known to those skilled in the art. It will also be noted that these martensitic steels are also sensitive to corrosion.

Attempts have been made to try to overcome these drawbacks with austenitic stainless steels, which have the peculiarity of being non-magnetic, namely paramagnetic or diamagnetic or antiferromagnetic. However, these austenitic steels have a crystallographic structure, which does not allow them to be hardened and to achieve levels of hardness, and thus wear resistance compatible with the requirements necessary for making timepiece pivot arbors. One means of increasing the hardness of these steels is cold working, however this hardening operation cannot achieve hardnesses of more than 500 HV. Consequently, for parts requiring high resistance to wear due to friction and requiring pivots which have little or no risk of deformation, the use of this type of steel remains limited.

Another approach for attempting to overcome these drawbacks consists in depositing hard layers of materials such as diamond-like-carbon (DLC) on the pivot arbors. However, there have been observed significant risks of delamination of the hard layer and thus the formation of debris which can move around inside the timepiece movement and disrupt the operation thereof, which is unsatisfactory.

A similar approach, described in FR Patent 2015873, proposes to make a balance staff wherein at least the main part is made of certain non-magnetic materials. The pivots may be made of this same material or of steel. It is also possible to arrange for the deposition of an additional layer applied by galvanic or chemical means or by gas phase (for example of Cr, Rh, etc.). This additional layer presents a significant risk of delamination. This document also describes a balance staff fabricated entirely of hardenable bronze. However, no information is provided as to the method for fabricating the pivots. Further, a component made of hardenable bronze has a hardness of less than 450 HV. Such a hardness seems insufficient for performing a rolling treatment to those skilled in the art.

There are also known, from EP Patent Application 2757423, pivot arbors made of an austenitic alloy of cobalt or nickel and having an outer surface hardened to a certain depth. However, such alloys may prove difficult to machine by chip removal. Moreover, they are relatively expensive because of the high cost of nickel and cobalt.

SUMMARY OF THE INVENTION

It is an object of the invention to overcome all or part of the aforementioned drawbacks by proposing a pivot arbor which both limits sensitivity to magnetic fields and can achieve an improved hardness compatible with the demands for wear and shock resistance required in the horological industry.

It is also an object of the invention to provide a non-magnetic pivot arbor having improved corrosion resistance.

It is yet another object of the invention to provide a non-magnetic pivot arbor which can be manufactured simply and economically.

To this end, the invention relates to a pivot arbor for a timepiece movement comprising at least one metal pivot at at least one of its ends.

According to the invention, the metal is a non-magnetic aluminium alloy in order to limit its sensitivity to magnetic fields, and at least the outer surface of said at least one pivot is deep-hardened with respect to the core of the arbor to a predetermined depth.

Consequently, a surface area or the entire surface of the arbor is hardened, i.e. the arbor core may be little modified or not modified. Through this selective hardening of portions of the arbor, the pivot arbor can enjoy advantages such as low sensitivity to magnetic fields, and hardness in the main stress areas, in addition to good corrosion resistance while still maintaining good general tenacity. Moreover, the use of such a non-magnetic aluminium alloy is advantageous inasmuch as these latter are highly machinable.

In accordance with other advantageous features of the invention:

the predetermined depth represents between 5% and 40% of the total diameter d of the pivot, typically between 5 and 35 microns;

the deep-hardened outer surface comprises diffused atoms of at least one chemical element;

the deep-hardened outer surface preferably has a hardness of more than 600 HV.

Moreover, the invention relates to a timepiece movement comprising a pivot arbor according to any of the preceding variants, and in particular a balance staff, a pallet staff and/or an escape pinion comprising an arbor as defined above.

Finally, the invention relates to a method for manufacturing a pivot arbor comprising the following steps:

a) forming, preferably by bar turning or any other chip removal machining technique, a pivot arbor comprising at least one metal pivot at one of its ends, said metal being a non-magnetic aluminium alloy, to limit its sensitivity to magnetic fields;

b) diffusing atoms by an ion implantation process to a predetermined depth in at least the outer surface of said pivot in order to deep-harden the pivot arbor in the main areas of stress while maintaining a high tenacity.

Consequently, by diffusing atoms in the aluminium alloy, a surface area or the entire surface of the pivots is hardened without having to deposit a second material over the pivots. Indeed, the hardening occurs within the material of the pivot arbor which, advantageously according to the invention, prevents any subsequent delamination which can occur where a hard layer is deposited on the arbor.

In accordance with other advantageous features of the invention:

the predetermined depth represents between 5% and 40% of the total diameter d of the pivot;

the atoms comprise at least one chemical element;

the pivots are rolled or polished after step b).

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

In the present description, the term "non-magnetic" means a paramagnetic or diamagnetic or antiferromagnetic material, whose magnetic permeability is less than or equal to 1.01.

An aluminium alloy is an alloy containing at least 50% by weight of aluminium.

The invention relates to a component for a timepiece movement and particularly to a non-magnetic pivot arbor for a mechanical timepiece movement.

The invention will be described below with reference to an application to a non-magnetic balance staff 1. Of course, other types of timepiece pivot arbors may be envisaged such as, for example, timepiece wheel set arbors, typically escape pinions or pallet staffs. Components of this type have a body with a diameter preferably less than 2 mm, and pivots with a diameter preferably less than 0.2 mm, with a precision of several microns.

Figure 1:
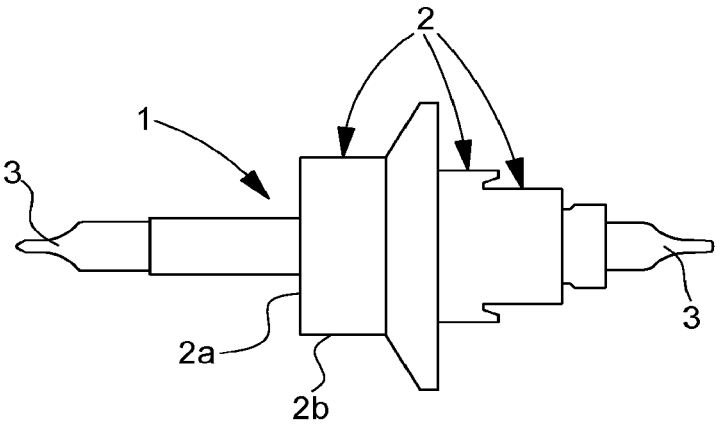
FIG. 1 is a representation of a pivot arbor according to the invention.

Referring to FIG. 1, there is shown a balance staff 1 according to the invention, which comprises a plurality of sections 2 of different diameters, preferably formed by bar turning or any other chip removal machining technique, and defining, in a conventional manner, bearing surfaces 2*a* and shoulders 2*b* arranged between two end portions defining two pivots 3. These pivots are each intended to pivot in a bearing typically in an orifice in a jewel or ruby.

With the magnetism induced by objects that are encountered on a daily basis, it is important to limit the sensitivity of balance staff 1 to avoid affecting the working of the timepiece in which it is incorporated.

Figure 2:
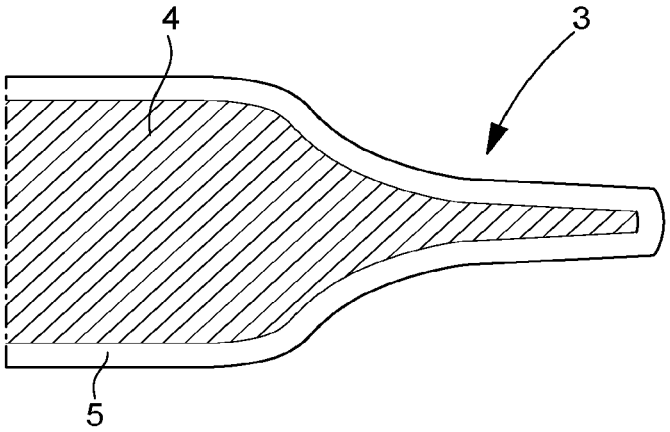
FIG. 2 is a partial cross-section of a balance staff pivot according to the invention, after the diffusion treatment operation via ion implantation and after the rolling or polishing operation.

Surprisingly, the invention overcomes both problems at the same time with no comprise and while providing additional advantages. Thus, the metal 4 of pivot 3 is a non-magnetic aluminium alloy so as to advantageously limit the sensitivity of the staff to magnetic fields. Further, at least the outer surface 5 of pivots 3 (FIG. 2) is deep-hardened to a predetermined depth with respect to the rest of pivot 3 advantageously by means of an ion implantation process, so as to offer, advantageously according to the invention, a superior hardness on said outer surface while maintaining high tenacity.

Indeed, according to the invention, the deep-hardened outer surface of pivots 3 has a hardness of more than 600 HV.

Preferably, the non-magnetic aluminium alloy is chosen from the group comprising an aluminium-copper-lead alloy, an aluminium-silicon-magnesium-manganese alloy, an aluminium-zinc-magnesium-copper alloy, wherein the proportions of the alloys is chosen to give them both non-magnetic properties and good machinability.

For example, the non-magnetic aluminium alloys used in the present invention, designated according to the standard DIN EN-673-3, are:

EN AW-2007 having the formula AlCu4PbMgMn (named Avional Pb118)

EN AW-2011 having the formula AlCu6BiPb (named Decoltal 500)

EN AW-6082 having the formula AlSi1MgMn (named Anticorodal 110/112)

EN AW-7075 having the formula AlZn5.5MgCu (named Perunal 215)

The aluminium alloy 7449 having the formula AlZn8Mg2Cu may also be used.

The composition values are given in mass percent. The elements with no indication of the composition value are either the remainder (aluminium) or elements whose percentage in the composition is less than 1% by weight.

Of course, other non-magnetic aluminium-based alloys may be envisaged provided the proportion of their constituents confers non-magnetic properties and good machinability.

It has been empirically demonstrated that a hardening depth of between 5% and 40% of the total diameter d of pivots 3 is sufficient for application to a balance staff. By way of example, if the radius d/2 is 50 μm, the hardening depth is preferably approximately 15 μm all around pivots 3. Evidently, depending upon the application, it is possible to provide a different hardening depth of between 5% and 80% of the total diameter d.

Preferably according to the invention, the deep-hardened outer surface 5 of pivots 3 comprises diffused atoms of at least one chemical element. For example, this chemical element may be a non-metal such as nitrogen, argon and/or helium. Indeed, as explained below, through the interstitial supersaturation of atoms in non-magnetic aluminium alloy 4, a surface area 5 is deep-hardened with no need to deposit a second material over pivots 3. Indeed, the hardening occurs within the material 4 of pivots 3 which, advantageously according to the invention, prevents any subsequent delamination during use. Consequently, outer surface 5 of pivot 3 comprises a hard surface layer, but has no additional hardening layer deposited directly on said outer surface 5. It is evident that other layers not having a hardening function may be deposited. Thus, it is possible, for example, to deposit a lubrication layer on the outer surface of the pivot.

Consequently, at least one surface area of the pivot is hardened, i.e. the core of pivots 3 and/or the rest of the arbor may remain little modified or unmodified without any significant change to the mechanical properties of balance staff 1. This selective hardening of pivots 3 of balance staff 1 makes it is possible to combine advantages, such as low sensitivity to magnetic fields, hardness and high tenacity, in the main areas of stress, while offering good corrosion and fatigue resistance.

The invention also relates to the method of manufacturing a balance staff as explained above. The method of the invention advantageously comprises the following steps:

a) forming, preferably by bar turning or any other chip removal machining technique, a balance staff 1 comprising at least one metal pivot 3 at each of its ends, said metal being a non-magnetic aluminium alloy, to limit its sensitivity to magnetic fields; and b) diffusing atoms to a predetermined depth by an ion implantation process at least in the outer surface 5 of pivots 3 so as to deep-harden the pivots in the main areas of stress.

Diffusion step b) comprises the diffusion of atoms of at least one chemical element, for example, a non-metal, such as nitrogen, argon and/or helium. This method has the advantage of not limiting the type of diffused atoms and of allowing both interstitial and substitutional diffusion.

The depth of hardening of outer surface 5 may advantageously be increased with the aid of a heat treatment performed during or after the ion implantation treatment step b).

According to a preferred embodiment, pivots 3 are rolled or polished after step b) in order to achieve the final dimensions and surface finish required for pivots 3. This rolling operation after treatment makes it possible to obtain arbors presenting improved resistance to wear and shocks compared to arbors whose pivots have simply been subjected to a hardening operation. Consequently, at least outer surface 5 of pivots 3 of the invention is rolled.

Advantageously according to the invention, regardless of the embodiment, the method can be applied in bulk. Finally, advantageously, it was discovered that the compressive stresses of the method improve fatigue and shock resistance.

The method according to the invention does not comprise any step of depositing an additional hardening layer directly onto outer surface 5 of pivot 3.

The pivot arbor according to the invention may comprise pivots treated according to the invention or be entirely made of non-magnetic aluminium alloy. Further, the diffusion treatment of step b) may be performed on the surface of the pivots or over the entire surfaces of the pivot arbor.

The pivot arbor according to the invention may advantageously be made by bar turning or any other chip removal machining technique using non-magnetic aluminium alloy bars with a diameter preferably less than 3 mm, and preferentially less than 2 mm. Aluminium alloys are known to those skilled in the art for being too soft to be able to be rolled and for wear resistance during use. However, in a surprising and unexpected manner, the use of such materials according to the invention makes it possible to make pivot arbors presenting a hardness of more than 600 HV which allows rolling to be performed and satisfactory longevity to be achieved during motion. To achieve the present invention, those skilled in the art had to overcome bias to use a non-magnetic aluminium based alloy to make a component of very small dimensions by means of a method comprising a step of bar turning (or any other chip removal machining method) and of rolling.

Against all expectations, the method of the invention makes it possible to obtain a timepiece pivot arbor wherein at least the pivots are formed by bar turning (or any other chip removal machining method) and rolling using a non-magnetic aluminium alloy.

Of course, this invention is not limited to the illustrated example but is capable of various variants and alterations which will be clear to those skilled in the art. In particular, it is possible to envisage entirely or virtually entirely treating pivots 3, i.e. treating more than 80% of the diameter d of pivots 3, although this is not necessary for the application to pivot pins such as timepiece balance staffs.

What is claimed is:

1. A pivot arbor for a timepiece movement comprising:

a plurality of sections have different diameters, which define bearing surfaces and shoulders arranged between two end portions, and at least one metal pivot at at least one of said end portion, wherein said pivot has a conical shape, wherein the metal is a non-magnetic aluminium alloy so as to limit the sensitivity of the pivot to magnetic fields, wherein at least the outer surface of said pivot is deep-hardened to a predetermined depth relative to the core of the pivot arbor, and wherein the non-magnetic aluminium alloy is chosen from the group consisting of an aluminium-copper-lead alloy, an aluminium-silicon-magnesium-manganese alloy, and an aluminium-zinc-magnesium-copper alloy.

2. The pivot arbor according to claim 1, wherein the predetermined depth represents between 5% and 40% of the total diameter (d) of the pivot.

3. The pivot arbor according to claim 1, wherein the deep-hardened outer surface comprises diffused atoms of at least one chemical element.

4. The pivot arbor according to claim 1, wherein the deep-hardened outer surface has a hardness of more than 600 HV.

5. The pivot arbor according to claim 1, wherein said outer surface of said pivot has no hardening layer directly deposited on said outer surface.

6. The pivot arbor according to claim 1, wherein at least the outer surface of said pivot is rolled.

7. The pivot arbor according to claim 1, wherein the pivot arbor has two pivots.

8. A movement for a timepiece comprising a pivot arbor, wherein said pivot arbor comprises:

a plurality of sections have different diameters, which define bearing surfaces and shoulders arranged between two end portions, and at least one metal pivot at at least one of said end portion, wherein said pivot has a conical shape, wherein the metal being a non-magnetic aluminium alloy so as to limit the sensitivity of the pivot to magnetic fields, wherein at least the outer surface of said pivot is deep-hardened to a predetermined depth relative to the core of the pivot arbor, and wherein the non-magnetic aluminium alloy is chosen from the group consisting of an aluminium-copper-lead alloy, an aluminium-silicon-magnesium-manganese alloy, and an aluminium-zinc-magnesium-copper alloy.

9. A movement for a timepiece wherein the movement comprises a balance staff, a pallet staff and/or an escape pinion comprising a pivot arbor comprising:

a plurality of sections have different diameters, which define bearing surfaces and shoulders arranged between two end portions, and at least one metal pivot at at least one of said end portion, wherein said pivot has a conical shape, wherein the metal being a non-magnetic aluminium alloy so as to limit the sensitivity of the pivot to magnetic fields, wherein at least the outer surface of said pivot is deep-hardened to a predetermined depth relative to the core of the pivot arbor, and wherein the non-magnetic aluminium alloy is chosen from the group consisting of an aluminium-copper-lead alloy, an aluminium-silicon-magnesium-manganese alloy, and an aluminium-zinc-magnesium-copper alloy.

10. A method for fabricating a pivot arbor for a timepiece movement comprising the following steps:

a) forming a plurality of sections have different diameters, which define bearing surfaces and shoulders arranged between two end portions, and at least one metal pivot at at least one of said end portion, wherein said pivot has a conical shape, wherein said metal being a non-magnetic aluminium alloy, to limit the sensitivity thereof to magnetic fields, wherein the non-magnetic aluminium alloy is chosen from the group consisting of an aluminium-copper-lead alloy, an aluminium-silicon-magnesium-manganese alloy, and an aluminium-zinc-magnesium-copper alloy;

b) diffusing atoms by an ion implantation process to a predetermined depth in at least the outer surface of said pivot in order to deep-harden the pivot arbor in the main areas of stress while maintaining a high tenacity.

11. The method according to claim 10, wherein the predetermined depth represents between 5% and 40% of the total diameter (d) of the pivot.

12. The method according to claim 10, wherein the diffusion step comprises the diffusion of atoms of at least one chemical element.

13. The method according to claim 10, wherein the method does not comprise any step of depositing a hardening layer directly on the outer surface of the pivot.

14. The method according to claim 10, wherein the pivot is subjected to a rolling/polishing step after step b).

* * * * *